United States Patent [19]

Stoy

[11] Patent Number: 4,627,300

[45] Date of Patent: Dec. 9, 1986

[54] POSITIONING ACTUATOR FOR SIX-HIGH ROLL STAND

[75] Inventor: Erich Stoy, Ratingen, Fed. Rep. of Germany

[73] Assignee: SMS Schloemann-Siemag AG, Dusseldorf, Fed. Rep. of Germany

[21] Appl. No.: 657,402

[22] Filed: Oct. 3, 1984

[30] Foreign Application Priority Data

Oct. 3, 1983 [DE] Fed. Rep. of Germany ..... 3335858

[51] Int. Cl.[4] ..... F16H 19/00; F16H 25/20

[52] U.S. Cl. ..... 74/89.15; 74/665 GD; 74/425

[58] Field of Search ..... 74/665 GD, 89.15, 425, 74/89.14; 72/243

[56] References Cited

U.S. PATENT DOCUMENTS

| | | | |
|---|---|---|---|
| 412,852 | 10/1889 | Kennedy et al. | 72/243 |
| 477,821 | 6/1892 | Potter | 72/243 |
| 3,247,697 | 4/1966 | Cozzo | 72/243 |

*Primary Examiner*—Lawrence Staab

*Attorney, Agent, or Firm*—Karl F. Ross; Herbert Dubno

[57] ABSTRACT

A positioning actuator for use between a working-roll journal block and a roll-stand frame has a housing, a worm shaft rotatable in the housing about a main axis and formed with two axially offset worms, and respective worm wheels meshing with the worms and rotatable in the housing about respective parallel axes lying in a plane parallel to but offset from the main axis. The worm wheels are each formed internally centered on the respective axis with a screwthread. Respective pusher rods extending along the worm-wheel axes through the worm wheels are each formed with an external screwthread complementary to and meshing with the respective internal screwthread. The rods and housing are coupled together so as to inhibit rotation of the rods about the respective worm-wheel axes while permitting movement of the rods along the respective worm-wheel axes. The screwthreads are of such hand that rotation of the worm shaft in one direction about the main axis moves the rods along the respective worm-wheel axes in one direction while opposite worm-shaft rotation moves the pusher rods axially oppositely.

9 Claims, 2 Drawing Figures

POSITIONING ACTUATOR FOR SIX-HIGH ROLL STAND

FIELD OF THE INVENTION

The present invention relates to a positioning actuator for a roll stand. More particularly this invention concerns such an actuator used to displace the working rolls horizontally in the workpiece-travel direction of a six-high roll stand.

BACKGROUND OF THE INVENTION

In a convertible roll stand of the type described in the commonly owned and concurrently filed patent application Ser. No. 657,415 now U.S. Pat. No. 4,563,888 a six-high roll stand is described wherein the working rolls can be displaced horizontally in the workpiece-travel direction from a position with the working-roll axes coplanar with the backup-roll axes to a position with the working-roll axes slightly downstream from this plane. This downstream position is employed when very small diameter working rolls are used, in installations for rolling very hard, thin, or wide steel strip, and in conjunction with some sort of downstream lateral bracing of these slender working rolls. For a fuller discussion of these systems, see, in addition to the above-mentioned patent application, pages 309–314 of *Herstellung von kaltgewalztem Band* (Verlag Stahleisen, Dusseldorf; 1970).

Such an installation comprises, as described in the above-mentioned patent application, a frame having a pair of sides spaced apart transversely of a workpiece travel direction and formed with respective throughgoing windows aligned transversely of the direction and a pair of vertically spaced traverses extending horizontally perpendicular to the direction between the frame sides. Two outer backup rolls centered on parallel axes transverse to the direction are spaced vertically apart and each have two journal blocks vertically displaceable and guided in the windows of the respective frame sides. Respective upper and lower guide elements limitedly vertically displaceable in the windows between the outer-roll journal blocks carry the journal blocks of two inner backup rolls centered on parallel axes between and coplanar with the outer-roll axes. Respective pairs of positioning actuators in the windows vertically between the respective inner-roll blocks have actuators which confront each other in the direction and are oppositely braced in the direction against the respective frame side. Respective supports carried on and between the actuators of each pair themselves carry respective upper and lower guide elements limitedly vertically displaceable on the supports. The positioning actuators are expansible and contractile to displace the guide elements in the direction. Two working rolls centered on parallel axes between and parallel to the other roll axes each have two journal blocks fitted to and axially slidable in the respective journal blocks. Thus the positioning actuators can position the working rolls in the direction. An insert is carried in the traverses axially between and secured to the positioning actuators upstream of the roll-axis plane. Respective rows of bracing rollers are carried on the insert and extend axially along the working rolls between same and the traverses. The insert, bracing rollers, and upstream positioning actuators form an integral bracing unit and at least one of the windows is shaped such that the bracing unit can be withdrawn axially through the respective frame side.

Respective rows of bracing actuators braced in the direction between the rollers and the traverses can displace the rollers through at least 50 mm in the direction and press the rollers opposite to the direction against the respective working rolls. Normally the inner backup rolls are axially displaceable with the respective journal blocks in the frame.

These positioning actuators that are braced via the respective supports and guide elements between the respective working-roll journal blocks and the confronting faces of the windows of the roll frame must be as short as possible in the workpiece travel direction so the windows do not have to be so wide that the frame is weakened. In addition they must be capable of exerting enormous forces, while applying no torsion to the elements they lie between as canting of the guide elements could impede proper machine operation. Finally, such devices should be capable of accurately moving into a set position and holding it perfectly.

The standard solution is one or more squat rams. Although such an arrangement does fit in with the normally hydraulic controls of a roll stand, it still requires extensive control technology, and due to the high pressures employed is a fairly expensive item.

Mechanical means such as wedges have been employed also, but these arrangements have the disadvantage of causing the controlled element to shift somewhat as there is a vector of force involved that does not run parallel to the positioning direction which is parallel to the workpiece-travel direction, and normally they are driven by threaded spindles that exert an appreciable torque on the entire actuator.

OBJECTS OF THE INVENTION

It is therefore an object of the present invention to provide an improved positioning actuator for a six-high roll stand.

Another object is the provision of such a positioning actuator for a six-high roll stand which overcomes the above-given disadvantages, that is which is very compact and capable of exerting very large forces, yet which can accurately produce exact movements that are purely unidirectional.

A further object is to provide such an actuator which can readily be ganged with another of nearly identical construction to produce synchronously opposite motion.

SUMMARY OF THE INVENTION

A positioning actuator for use between a working-roll journal block and a roll-stand frame according to the invention has a housing, a worm shaft rotatable in the housing about a main axis and formed with two axially spaced worms, and respective worm wheels meshing with the worms and rotatable in the housing about respective parallel axes lying in a plane parallel to but offset from the main axis. The worm wheels are each formed with a screwthread internally centered on the respective axis. Respective pusher rods extending along the worm-wheel axes through the worm wheels are each formed with an external screwthread complementary to and meshing with the respective internal screwthread. The rods and housing are coupled together so as to inhibit rotation of the rods about the respective worm-wheel axes while permitting movement of the rods along the respective worm-wheel axes. The screwthreads are of such hand that rotation of the worm shaft in one direction about the main axis moves the rods along the respective worm-wheel axes in one direction while opposite worm-shaft rotation moves the pusher rods axially oppositely.

In fact according to this invention a pair of such worm wheels, each with a respective internal thread and pusher rod, can flank and mesh with each of the worms.

With this system it is therefore possible to displace the rods perfectly uniaxially. The double stepdown obtained, first at the screwthread between the worm and the worm wheel and then between the internal screwthread and the respective external screwthread, can produce a huge mechanical advantage while making it possible for the part being actuated, since of course this actuator could be used as a jack or the like in other applications, to be very accurately positioned.

According to another feature of this invention the screwthread of one worm wheel of each worm-wheel pair and the respective pusher-rod screwthread are of a hand opposite that of the other worm wheel of the pair and the respective pusher-rod screwthread. This construction ensures perfectly synchronous movement of the pusher rod, while balancing the load on the worm shaft to relieve its mounting bearings.

In accordance with another feature of this invention at least one axial-thrust bearing and at least one radial-thrust bearing support the worm shaft in the housing. The radial thrust bearing is between the worms. The worm wheels can be similarly mounted, each by one or two axially spaced axial-thrust bearings and one or two axially spaced radial-thrust bearings. Thus the worm shaft and worm wheels are very accurately positioned with respect to each other so they will not wear. Similarly the push rods will be self-centering. The housing also is formed with passages hermetically receiving the rods and centered on the respective worm-wheel axes. Thus it is possible to fill this housing with a lubricant, thereby ensuring a very long service life.

The outer ends of the pusher rods according to this invention are all fixed in a plate extending transverse to the worm-wheel axes. The actuator is formed as a parallepipedal box which can expand in one direction with its planar outer surfaces remaining perfectly parallel, and which has a single input shaft projecting out of its one side between the surfaces and parallel thereto.

DESCRIPTION OF THE DRAWING

The above and other features and advantages will become more readily apparent from the following description, reference being made to the accompanying drawing in which.

SPECIFIC DESCRIPTION

Figure 1:
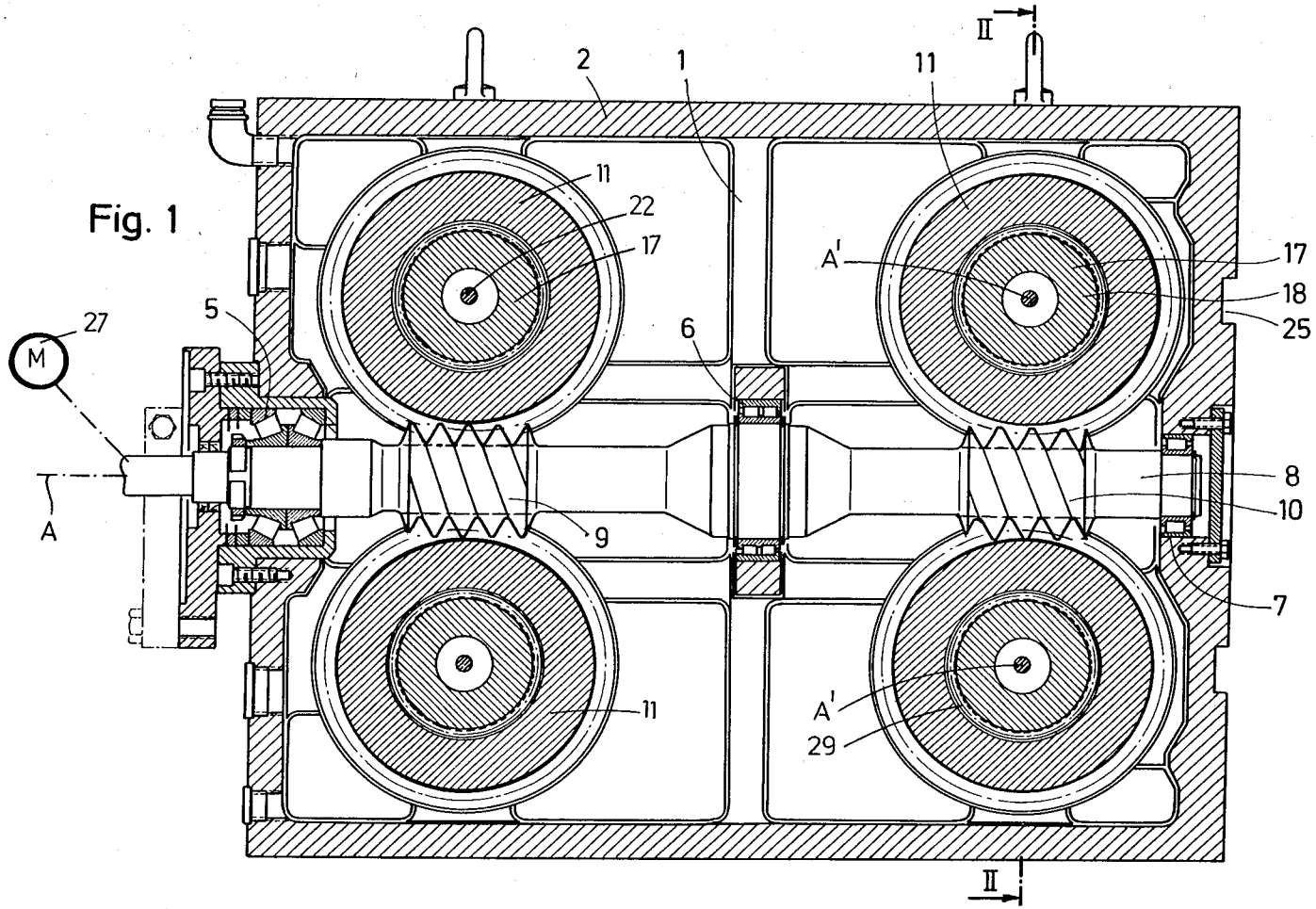
FIG. 1 is a partly diagrammatic section through the actuator of this invention.

The actuator according to this invention has a massive housing 2 cast with ribs 1 and having one side closed by a pair of cover plates 4 secured in place by screws 26 with a seal 3 around the joint. A main input or drive shaft 8 extending along an axis A and rotatable thereabout in either direction by a motor 27 is supported in this housing 2, 4 by an axial-thrust bearing 5 at one housing end, a radial-thrust bearing 6 in the housing middle, and another radial-thrust bearing 7 at the opposite housing end.

This shaft 8 is formed with two worms 9 and 10 of identical pitch and each meshing with a pair of identical worm wheels 11 centered on axes A′ that all extend parallel to one another and to the workpiece travel direction through the roll stand in which the device according to this invention is to be used. Each such wheel is supported in the housing 2, 4 by two axial-thrust bearings 12 and 15 and two radial-thrust bearings 13 and 14. Thus neither the worm shaft 8 nor any of the wheels 11 can move other than rotationally in the housing 2, 4 about the respective axes A and A′. Furthermore, each worm wheel 11 is tubular, being formed centered on the respective axis A′ with an axially throughgoing passage or bore 28 centrally formed with an internal screwthread 29.

The end walls of the housing 2, 4 are formed centered on the axes A′ with throughgoing cylindrical guide passages 16 so that tubular pusher rods 17 can extend through these passages 16 and through the aligned passages 28 of the gear wheels 11. These rods 17 are formed with central threaded regions that mesh with the respective screwthreads 29. Guide bushings 19 and 20 ensure smooth sliding parallel to the axes A′ of the rods 17 in the passages 16.

Figure 2:
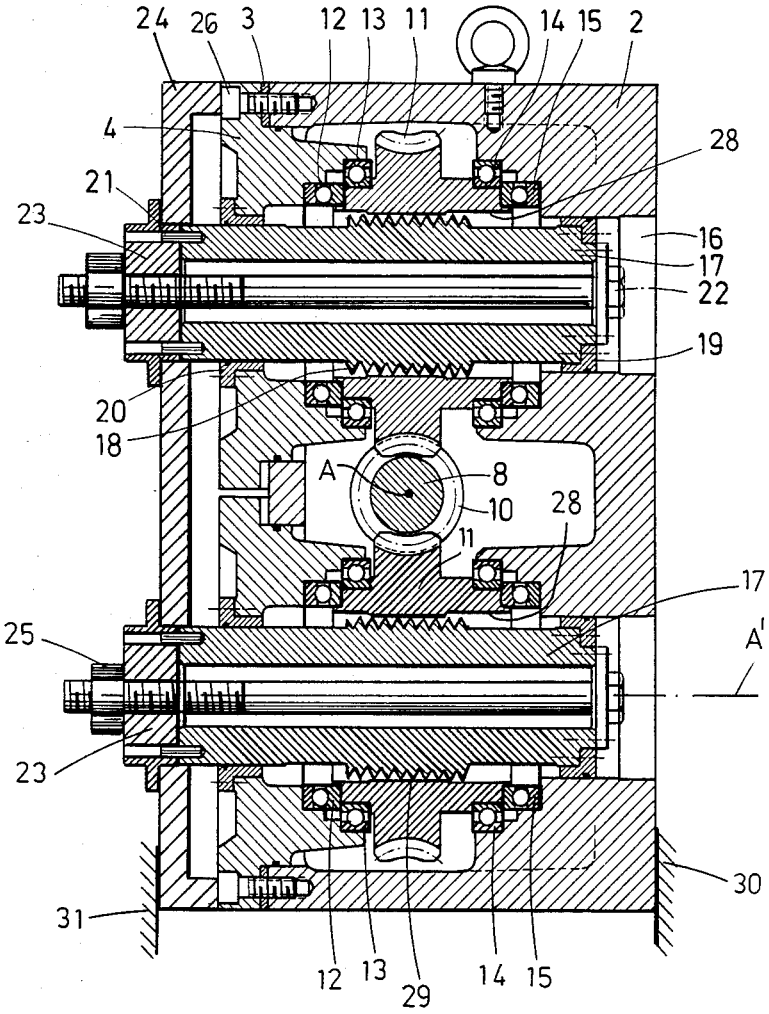
FIG. 2 is a section taken along line II—II of FIG. 1.

The outer ends, those on the left in FIG. 2, of the rods 17 are rotationally coupled by axially extending pins 21 to fittings 23 bolted to an end abutment or support plate 24. The rods 17 are axially secured to this plate 24 by a bolt 22 having a head bearing against the inner rod end and a nut 25 bearing oppositely against the fitting 23.

In use the inside housing face bears against the side of a window of a roll-stand frame shown schematically at 30 and the opposite face bears carries the two guide elements for the journal block at the upstream or downstream side of a working roll shown schematically at 31. The axes A′ extend horizontally parallel to the travel direction of the workpiece through the roll stand, and the axis A extends horizontally perpendicular to this direction, with the left-hand side of the housing 2, 4 as seen in FIG. 1 turned away from the roll stand.

Rotation of the shaft 8 around the axis A will therefore synchronously rotate all the wheels 11 about the respective axes A′. This will screw the rods 17 axially in these gears 11, pushing the plate 24 away from the housing 2, 4 while keeping it perfectly parallel thereto. Since the upper and lower wheels 11 will be rotated oppositely, the respective screwthreads 29 and 18 should similarly be of opposite hand, but identical pitch, for the desired movement.

Such an arrangement will produce perfect uniaxial motion, as the huge stepdown in this type of worm gearing will make any torque transmitted about the axis A to the housing 2, 4 virtually imperceptible. This type of gearing is also normally considered to be one-way, that is the shaft 8 can drive the wheels 11, but not vice versa, so that once the desired position is obtained, it will be held merely by not driving the shaft 8, that is without providing special braking. The interior of the housing 2, 4 is completely sealed also, so the entire transmission can be filled with a lubricant for the best possible continuous lubrication.

Another advantage of this type of system is that it is possible to use two virtually identical such arrangements flanking the working rolls and to drive them from a common transmission having one input shaft and two output shafts that rotate synchronously. The use of wheels 11 and rods 17 of appropriate hand, but all of the same pitch, will ensure perfectly synchronous movement of the working rolls, with the position of the single main input shaft being an accurate measure of the exact working-roll position. In fact these units according to the invention can be ganged, that is stacked, to increase the total stroke, in which case they would have to be somewhat embedded in one another and/or in the roll-stand frame to all fit.

The arrangement of this invention is made of simple and interchangeable parts. In fact even drives intended to expand on right-hand input-shaft rotation and to retract on left-hand rotation have the same parts as ones for opposite operation, merely in different positions.

I claim:

1. A positioning actuator for location within a window of a roll-stand frame between a pair of working-roll journal blocks and wall of the window of the roll-stand frame so as to shift the working rolls horizontally in a lateral direction of strip travel, the actuator comprising:

a housing of a size to fit in said window between said wall and said journal blocks;

a worm shaft rotatable in the housing about a main axis and formed with two axially offset worms;

respective pairs of worm wheels flanking and meshing with the worms, the wheels being rotatable in the housing about respective parallel axes lying in planes parallel to, flanking, and offset from the main axis, the worm wheels each being formed internally centered on the respective axis with a screwthread;

respective pusher rods extending along the worm-wheel axes through the worm wheels and each formed with an external screwthread complementary to and meshing with the respective internal screwthread;

means engaging the rods and housing for inhibiting rotation of the rods about the respective worm-wheel axes while permitting movement of the rods along the respective worm-wheel axes, the screwthreads being of such hand that rotation of the worm shaft in one direction about the main axis moves the rods synchronously along the respective worm-wheel axes in one direction while opposite worm-shaft rotation moves the pusher rods axially oppositely; and two respective axial-thrust bearings and two respective radial-thrust bearings supporting each of the worm wheels in the housing.

2. A positioning actuator for location within a window of a roll-stand frame between a pair of working-roll journal blocks and wall of the window of the roll-stand frame so as to shift the working rolls horizontally in a lateral direction of strip travel, the actuator comprising:

a housing of a size to fit in said window between said wall and said journal blocks;

a worm shaft rotatable in the housing about a main axis and formed with two axially offset worms;

respective pairs of worm wheels flanking and meshing with the worms, the wheels being rotatable in the housing about respective parallel axes lying in planes parallel to, flanking, and offset from the main axis, the worm wheels each being formed internally centered on the respective axis with a screwthread;

respective pusher rods extending along the worm-wheel axes through the worm wheels and each formed with an external screwthread complementary to and meshing with the respective internal screwthread; and means engaging the rods and housing for inhibiting rotation of the rods about the respective worm-wheel axes while permitting movement of the rods along the respective worm-wheel axes, the screwthreads being of such hand that rotation of the worm shaft in one direction about the main axis moves the rods synchronously along the respective worm-wheel axes in one direction while opposite worm-shaft rotation moves the pusher rods axially oppositely.

3. The actuator defined in claim 2 wherein the screwthread of one worm wheel of each worm-wheel pair and the respective pusher-rod screwthread are of a hand opposite that of the other worm wheel of the pair and the respective pusher-rod screwthread.

4. The actuator defined in claim 2, further comprising at least one axial-thrust bearing and at least one radial-thrust bearing supporting the worm shaft in the housing.

5. The actuator defined in claim 4 wherein the radial thrust bearing is between the worms.

6. The actuator defined in claim 2, further comprising at least one respective axial-thrust bearing and at least one respective radial-thrust bearing supporting the worm wheels in the housing.

7. The actuator defined in claim 6 wherein two such axial bearings and two such radial bearing support each such worm wheel in the housing.

8. The actuator defined in claim 2 wherein each pusher rod has an outer end, the means including a plate fixed to the outer ends and extending transverse to the worm-wheel axes.

9. The actuator defined in claim 2 wherein the housing is formed with passages hermetically receiving the rods and centered on the respective worm-wheel axes.

* * * * *